US008421354B2

(12) United States Patent
Watase et al.

(10) Patent No.: US 8,421,354 B2
(45) Date of Patent: Apr. 16, 2013

(54) PHOTOCATHODE, PHOTOMULTIPLIER AND ELECTRON TUBE

(75) Inventors: Fumio Watase, Shizouka (JP); Shinichi Yamashita, Shizuoka (JP); Hiroyuki Watanabe, Shizouka (JP)

(73) Assignee: Hamamatsu Photonics K.K., Hamamatsu-shi, Shizuoka (JP)

( * ) Notice: Subject to any disclaimer, the term of this patent is extended or adjusted under 35 U.S.C. 154(b) by 601 days.

(21) Appl. No.: 11/960,169

(22) Filed: Dec. 19, 2007

(65) Prior Publication Data

US 2010/0096985 A1 Apr. 22, 2010

Related U.S. Application Data

(60) Provisional application No. 60/877,370, filed on Dec. 28, 2006.

(51) Int. Cl.
*H01J 43/18* (2006.01)
*H01J 40/06* (2006.01)

(52) U.S. Cl.
USPC ..... 313/533; 313/542; 313/544

(58) Field of Classification Search ..... 250/207, 250/216, 226, 234; 357/9, 18, 301; 438/427; 313/542, 544, 532, 534, 535, 539, 106, 527, 313/533, 104, 103 R, 103 CM, 105 CM, 313/537; 427/77, 74
See application file for complete search history.

(56) References Cited

U.S. PATENT DOCUMENTS

| | | | | |
|---|---|---|---|---|
| 3,254,253 | A | 5/1966 | Davis et al. | |
| 3,631,303 | A | 12/1971 | Antypas | |
| 4,311,939 | A | 1/1982 | Faulkner et al. | |
| 4,339,469 | A * | 7/1982 | McDonie et al. | 427/10 |
| 4,341,427 | A * | 7/1982 | Tomasetti et al. | 445/6 |
| 4,419,603 | A | 12/1983 | Nussli et al. | |
| 4,490,605 | A | 12/1984 | Dolizy et al. | |
| 4,639,638 | A * | 1/1987 | Purcell et al. | 313/534 |
| 5,336,966 | A | 8/1994 | Nakatsugawa et al. | |
| 2005/0217722 | A1 * | 10/2005 | Komatsu et al. | 136/263 |
| 2006/0055322 | A1 * | 3/2006 | Sugiyama et al. | 313/542 |

FOREIGN PATENT DOCUMENTS

| | | |
|---|---|---|
| EP | 0 259 878 | 3/1988 |
| JP | 43-2097 | 1/1943 |
| JP | 47-8253 | 3/1972 |
| JP | 48-85072 | 11/1973 |
| JP | 49-84362 | 8/1974 |
| JP | 56-147352 | 11/1981 |
| JP | 57-055048 A | 4/1982 |
| JP | 62-20654 | 5/1987 |
| JP | 2500209 | 3/1991 |

(Continued)

*Primary Examiner* — Anh Mai
*Assistant Examiner* — Elmito Breval
(74) *Attorney, Agent, or Firm* — Drinker Biddle & Reath LLP

(57) ABSTRACT

The present invention relates to a photocathode having a structure to dramatically improve the effective quantum efficiency in comparison with that of a conventional art, an photomultiplier and an electron tube. The photocathode comprises a supporting substrate transmitting or blocking an incident light, a photoelectron emitting layer containing an alkali metal provided on the supporting substrate, and an underlayer provided between the supporting substrate and the photoelectron emitting layer. Particularly, the underlayer contains a beryllium oxide, and is adjusted in its thickness such that a thickness ratio of the underlayer to the photoelectron emitting layer falls within a specific range. This structure allows to obtain a photocathode having a dramatically improved quantum efficiency.

15 Claims, 5 Drawing Sheets

FOREIGN PATENT DOCUMENTS

| | | | | |
|---|---|---|---|---|
| JP | 5-52444 | | | 8/1993 |
| JP | 5-299052 | | | 11/1993 |
| JP | 6-068840 | | | 3/1994 |
| JP | 8-083561 | | | 3/1996 |
| JP | 08-096705 | A | | 4/1996 |
| JP | 09-199075 | A | | 7/1997 |
| JP | 11-135003 | A | | 5/1999 |
| JP | 11135003 | A | * | 5/1999 |
| JP | 11-297191 | A | | 10/1999 |
| JP | 2003-203581 | | | 7/2003 |
| WO | WO-2004/066338 | A1 | | 8/2004 |

* cited by examiner

*Fig.4A*

| STRUCTURE No. | UNDERLAYER |
|---|---|
| 1 | BeO |
| 2 | BeO-MgO,BeO / MgO OR MgO / BeO |
| 3 | BeO-MnO,BeO / MnO OR MnO / BeO |
| 4 | OXIDE OF Be-ALLOY |
| 5 | BeO-RELATED FOUNDATION/AR-COATING ($HfO_2$,$Y_2O_3$) |

*Fig.4B*

| STRUCTURE No. | PHOTOELECTRON EMITTING LAYER |
|---|---|
| 1 | K-CsSb ($K_2CsSb$) |
| 2 | Na-K Sb ($Na_2KSb$) |
| 3 | Cs-Na-K Sb ($Cs(Na_2K)Sb$) |
| 4 | Cs-Te Sb ($Cs_2TeSb$) |

PHOTOCATHODE, PHOTOMULTIPLIER AND ELECTRON TUBE

CROSS-REFERENCE TO RELATED APPLICATION

This application claims priority to Provisional Application Ser. No. 60/877,370 filed on Dec. 28, 2006 by the same Applicant, which is hereby incorporated by reference in its entirety.

BACKGROUND OF THE INVENTION

1. Field of the Invention

The present invention relates to a photocathode that emits photoelectrons in response to incidence of light with a predetermined wavelength, and a photomultiplier and an electron tube each including the same.

2. Related Background Art

A photocathode is, as described in, for example, U.S. Pat. No. 3,254,253, a device that emits electrons (photoelectrons) generated in response to an incident light. Such a photocathode is favorably applied to an electron tube such as a photomultiplier. In addition, the photocathode can be of two types: transmissive and reflective, according to the difference in supporting substrate materials to be applied thereto.

In a transmissive photocathode, a photoelectron emitting layer is formed on a supporting substrate comprised of a material that transmits an incident light, and a part of a transparent container of a photomultiplier or the like functions as the supporting substrate. In this case, when an incident light transmitted through the supporting substrate reaches the photoelectron emitting layer, photoelectrons are generated within the photoelectron emitting layer in response to the reached incident light. As a result of an electric field for a photoelectron extraction being formed on the side opposite to the supporting substrate when viewed from the photoelectron emitting layer, the photoelectrons generated within the photoelectron emitting layer are emitted toward a direction coincident with a traveling direction of the incident light.

On the other hand, in a reflective photocathode, a photoelectron emitting layer is formed on a supporting substrate comprised of a material that blocks an incident light, and the supporting substrate is arranged inside a transparent container of a photomultiplier. In this case, the supporting substrate functions as a reinforcing member to support the photoelectron emitting layer, and an incident light directly reaches the photoelectron emitting layer while avoiding the supporting substrate. Within the photoelectron emitting layer, photoelectrons are generated in response to the reached incident light. The photoelectrons generated within the photoelectron emitting layer are, as a result of an electric field for a photoelectron extraction being formed on the side opposite to the supporting substrate when viewed from the photoelectron emitting layer, emitted to the side from which the incident light has traveled and reached when viewed from the supporting substrate.

SUMMARY OF THE INVENTION

The present inventors have examined the above prior art, and as a result, have discovered the following problems. That is, it is preferable that spectral sensitivity required for a photocathode serving as a photoelectric conversion device is higher. In order to increase the spectral sensitivity, it is necessary to enhance an effective quantum efficiency of the photocathode indicating a ratio of the number of emitted photoelectrons to the number of incident photons. For example, U.S. Pat. No. 3,254,253 mentioned above has examined a photocathode provided with an anti-reflection coating between a supporting substrate and a photoelectron emitting layer. However, in recent years, a further improvement in quantum efficiency has been demanded.

The present invention has been developed to eliminate the problems described above. It is an object of the present invention to provide a photocathode having a structure to dramatically improve the effective quantum efficiency in comparison with that of a conventional photocathode, and a photomultiplier and an electron tube each including the same.

A photocathode according to the present invention comprises a supporting substrate, an underlayer provided on the supporting substrate while being in direct contact with the supporting substrate, and a photoelectron emitting layer containing an alkali metal provided on the underlayer while being in direct contact with the underlayer. The photocathode can be of two types: transmissive and reflective, according to the difference in supporting substrate materials to be applied thereto. In the case of a transmissive photocathode, the supporting substrate is comprised of a glass material such as, for example, silica glass or borosilicate glass. Also, in the case of a reflective photocathode, the supporting substrate is comprised of a material that blocks an incident light, for example, a metal such as nickel.

A photocathode according to the present invention has, in either case of the transmissive and reflective types, a light incident surface into which light with a predetermined wavelength is made incident and a photoelectron emitting surface that emits photoelectrons in response to incidence of the light. In concrete terms, in the photocathode, the supporting substrate has a first main surface and a second main surface opposing the first main surface. The photoelectron emitting layer containing an alkali metal also likewise has a first main surface and a second main surface opposing the first main surface. In addition, the photoelectron emitting layer is provided on the second main surface of the supporting substrate such that the first main surface of the photoelectron emitting layer faces the second main surface of the supporting substrate. And, the underlayer is provided between the supporting substrate and photoelectron emitting layer while being in direct contact with both the second main surface of the supporting substrate and the first main surface of the photoelectron emitting layer.

Here, when the photocathode is a transmissive photocathode, the first main surface of the supporting substrate functions as the light incident surface, while the second main surface of the photoelectron emitting layer functions as the photoelectron emitting surface. On the other hand, when the photocathode is a reflective photocathode, the second main surface of the photoelectron emitting layer not only functions as the light incident surface but functions also as the photoelectron emitting surface.

In particular, the photocathode according to the present invention has been achieved by the inventors' finding that, by providing an underlayer containing a beryllium element (Be) between a supporting substrate and a photoelectron emitting layer, the photocathode is improved in the effective quantum efficiency in comparison with the conventional photocathode.

As described above, since the photocathode according to the present invention has a simple structure where an underlayer containing a beryllium element is provided between a supporting substrate and a photoelectron emitting layer provided thereon, due to existence of this underlayer, diffusion of an alkali metal (for example, K, Cs, and the like) contained in the photoelectron emitting layer to the supporting substrate side is suppressed at the time of thermal treatment in a manufacturing process of the photocathode. That is, a decline in the quantum efficiency of the photoelectron emitting layer is effectively suppressed. Further, it can be assumed that this underlayer functions so as to reverse the direction of, out of photoelectrons generated within the photoelectron emitting layer, photoelectrons traveling toward the supporting substrate side (the first main surface of the photoelectron emitting layer). For this reason, it can be considered that the quantum efficiency of the photocathode as a whole is dramatically improved.

Meanwhile, in this specification, the effective quantum efficiency means a quantum efficiency in a photocathode as a whole including the supporting substrate and the like as well as in terms of the photoelectron emitting layer. Therefore, a factor such as a transmittance of the supporting substrate is also reflected on the effective quantum efficiency. In addition, the underlayer of the photocathode including a beryllium element can be realized by various structures, such as a single-layer structure comprised of an oxide of a beryllium alloy or a beryllium oxide, and a multi-layer structure including a layer (BeO-related foundation) containing, as a main material, a beryllium oxide or a beryllium oxide single-layer. The inventors have confirmed that a high quantum efficiency can be obtained, for example, in either case where the underlayer includes mixed crystals of a beryllium oxide (BeO) and a magnesium oxide (MgO), where the underlayer includes mixed crystals of a beryllium oxide (BeO) and a manganese oxide (MnO), where the underlayer includes mixed crystals of a beryllium oxide (BeO) and a yttrium oxide ($Y_2O_3$), and where the underlayer includes mixed crystals of a beryllium oxide (BeO) and a hafnium oxide ($HfO_2$). Here, the underlayer may have a multi-layer structure including a layer comprised of mixed crystals of a beryllium oxide and a magnesium oxide, a layer comprised of mixed crystals of a beryllium oxide and a manganese oxide, a layer comprised of mixed crystals of a beryllium oxide and a yttrium oxide, or a layer comprised of mixed crystals of a beryllium oxide and a hafnium oxide. Furthermore, the underlayer may comprise a layer containing a beryllium oxide, and a hafnium oxide film provided between such a layer containing the beryllium oxide and the supporting substrate.

In the photocathode according to the present invention, it is preferable that the photoelectron emitting layer is comprised of a compound of antimony (Sb) and an alkali metal. In addition, it is preferable that the alkali metal contains at least one of cesium (Cs), potassium (K), and sodium (Na).

In the photocathode according to the present invention, it is preferable that a thickness of the underlayer is set such that a ratio of a thickness of the photoelectron emitting layer to the thickness of the underlayer falls within the range of 0.1 or more but 100 or less.

The photocathode according to the present invention can be, in either case of the transmissive and reflective types, appropriately applied to an electron tube (an electron tube according to the present invention) such as a photomultiplier (a photomultiplier according to the present invention). In this case, the electron tube comprises a transmissive or reflective photocathode having the structure as described above, an anode that collects electrons emitted from the photocathode, and a container that stores the photocathode and the anode. In addition, the photomultiplier comprises a transmissive or reflective photocathode having the structure as described above, an electron multiplier section having a plurality of stages of dynodes for cascade-multiplying photoelectrons emitted form the photocathode, an anode collecting secondary electrons emitted from the electron multiplier section, and a container accommodating the photocathode, electron multiplier section, and the anode.

The present invention will be more fully understood from the detailed description given hereinbelow and the accompanying drawings, which are given by way of illustration only and are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the scope of the invention will be apparent to those skilled in the art from this detailed description.

BRIEF DESCRIPTION OF THE DRAWINGS

FIG. 4A is a table for explaining types of underlayer structures applied to a plurality of samples prepared as photocathodes according to the present invention, and FIG. 4B is a table for explaining types of photoelectron emitting layer structures applied to a plurality of samples prepared as photocathodes according to the present invention.

DESCRIPTION OF THE PREFERRED EMBODIMENTS

Figure 1A:
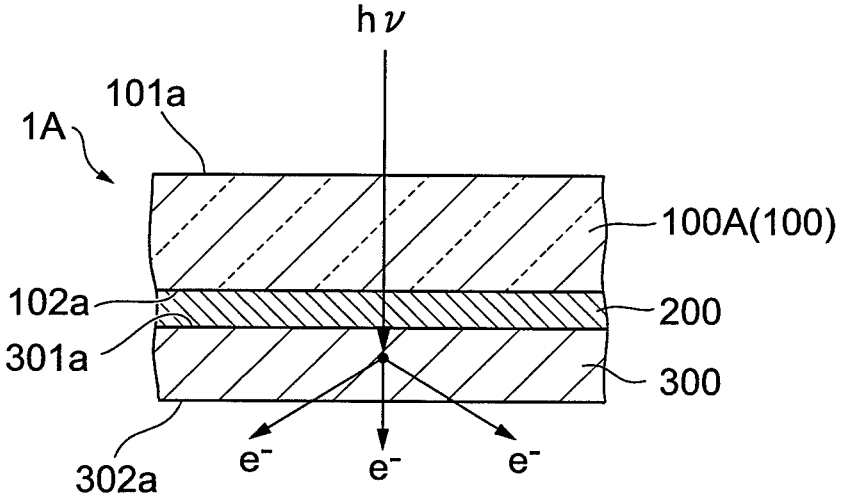
FIG. 1A is a view showing a cross sectional structure of a transmissive photocathode as a photocathode according to the present invention.

In the following, embodiments of a photocathode and a photomultiplier (included in an electron tube) according to the present invention will be explained in detail with reference to FIGS. 1A-1B, 2-3, 4A-4B and 5. In the description of the drawings, identical or corresponding components are designated by the same reference numerals, and overlapping description is omitted.

FIG. 1A is a view showing a cross sectional structure of a transmissive photocathode as a photocathode according to the present invention. In addition, FIG. 1B is a view showing a cross sectional structure of a reflective photocathode as a photocathode according to the present invention.

The transmissive photocathode 1A shown in FIG. 1A comprises a supporting substrate 100A that transmits an incident light hν with a predetermined wavelength, an underlayer 200 provided on the supporting substrate 100A, and a photoelectron emitting layer 300 provided on the underlayer 200. The supporting substrate 100A has a first main surface 101*a* that functions as a light incident surface of the transmissive photocathode 1A, and a second main surface 102*a* opposing the first main surface 101*a*. The photoelectron emitting layer 300 has a first main surface 301*a* that opposes the second main surface 102*a* of the supporting substrate 100A and a second main surface 302*a* that opposes the first main surface 301*a*, and then functions as a photoelectron emitting surface of the transmissive photocathode 1A. In addition, the underlayer 200 is arranged between the supporting substrate 100A and the photoelectron emitting layer 300 while being in direct contact with both the second main surface 102*a* of the supporting substrate 100A and the first main surface 301*a* of the photoelectron emitting layer 300. That is, for this transmissive photocathode 1A, an incident light hν is made incident from the supporting substrate 100A side and electrons $e^-$ are emitted from the photoelectron emitting layer 300 side in response to the incident light hν.

In the transmissive photocathode 1A, it is preferable that the supporting substrate 100A is comprised of a material that transmits light with a wavelength of 300 nm to 1000 nm. As such a supporting substrate material, for example, silica glass and borosilicate glass are appropriate.

Figure 1B:
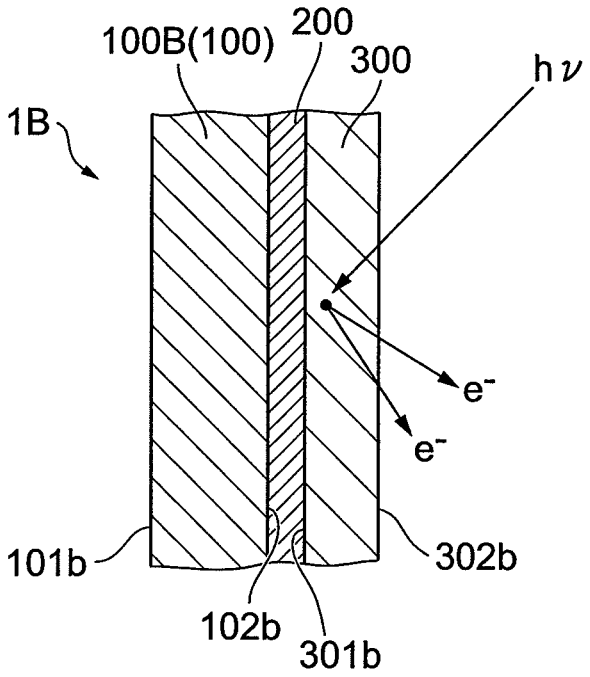
FIG. 1B is a view showing a cross sectional structure of a reflective photocathode as a photocathode according to the present invention.

On the other hand, a reflective photocathode 1B shown in FIG. 1B comprises a supporting substrate 100B that blocks an incident light hν with a predetermined wavelength, an underlayer 200 provided on the supporting substrate 100B, and a photoelectron emitting layer provided on the underlayer 200. The supporting substrate 100B has a first main surface 101*b* and a second main surface 102*b* opposing the first main surface 101*b*. The photoelectron emitting layer 300 has a first main surface 301*b* opposing the second main surface 102*b* of the supporting substrate 100B and a second main surface 302*b* opposing the first main surface 301*b*, and functions as both a light incident surface and a photoelectron emitting surface of the reflective photocathode 1B. In addition, the underlayer 200 is arranged between the supporting substrate 100B and the photoelectron emitting layer 300 while being in direct contact with both the second main surface 102*b* of the supporting substrate 100B and the first main surface 301*b* of the photoelectron emitting layer 300. That is, for this reflective photocathode 1B, when an incident light hν has reached the supporting substrate 100B from the photoelectron emitting layer 300, photoelectrons $e^-$ are emitted from the supporting substrate 100B in a direction toward the photoelectron emitting layer 300 in response to the incident light hν.

In such a reflective photocathode 1B, it is preferable that the supporting substrate 100B is comprised of a metal material such as a nickel supporting substrate since this functions as a reinforcing member to support the photoelectron emitting layer 300.

In both the transmissive photocathode 1A and transmissive photocathode 1B as described above, the underlayer 200 and the photoelectron emitting layer 300 may have the same structures.

That is, the underlayer 200 contains a Be element. In concrete terms, the underlayer 200 can be realized by various structures, such as a single-layer structure comprised of an oxide of a Be-alloy or BeO, and a multi-layer structure including a layer (BeO-related foundation) containing, as a main material, BeO or a BeO single-layer. For example, besides the BeO single-layer, mixed crystals of BeO and MgO ($Be_XMg_YO_Z$), mixed crystals of BeO and MnO ($Be_XMn_YO_Z$), mixed crystals of BeO and $Y_2O_3$ ($Be_XY_YO_Z$), mixed crystals of BeO and $HfO_2$ ($Be_XHf_YO_Z$) may be used. The underlayer 200 having such a structure can be obtained by one of the pair of Be and Mg, the pair of Be and Mn, the pair of Be and Y, and the pair of Be and Hs being oxidized after simultaneously being vapor-deposited onto the substrate. Or, the underlayer 200 can be also obtained by oxidizing one of Mg, Mn, Y and Hf after being vapor-deposited subsequent to vapor-depositing Be (since there is a possibility that Be is insufficiently oxidized when the Be is vapor-deposited first and then another metal material is vapor-deposited, it is preferable to hold a mass ratio of the other metal material to the total mass of the underlayer down to 20% or less in such a manufacturing method). Here, in the case of mixed crystals, it is preferable to set the ratio of Be to more than 50% in terms of a mass ratio to the mixed crystals as a whole including another metal material. This can be realized by setting the mass of Be prepared at the time of manufacturing greater than to the total mass of another metal material such as Mg, Mn, and the like.

It is preferable that the photoelectron emitting layer 300 is comprised of a compound of antimony (Sb) and an alkali metal. In addition, it is preferable that the alkali metal contains at least one of cesium (Cs), potassium (K), and sodium (Na). Such a photoelectron emitting layer 300 functions as an active layer of the photocathode 1A.

Also, in the following description, a supporting substrate simply mentioned without limitation to either transmissive or reflective photocathode 1A or 1B will be denoted with a reference numeral "100."

Figure 2:
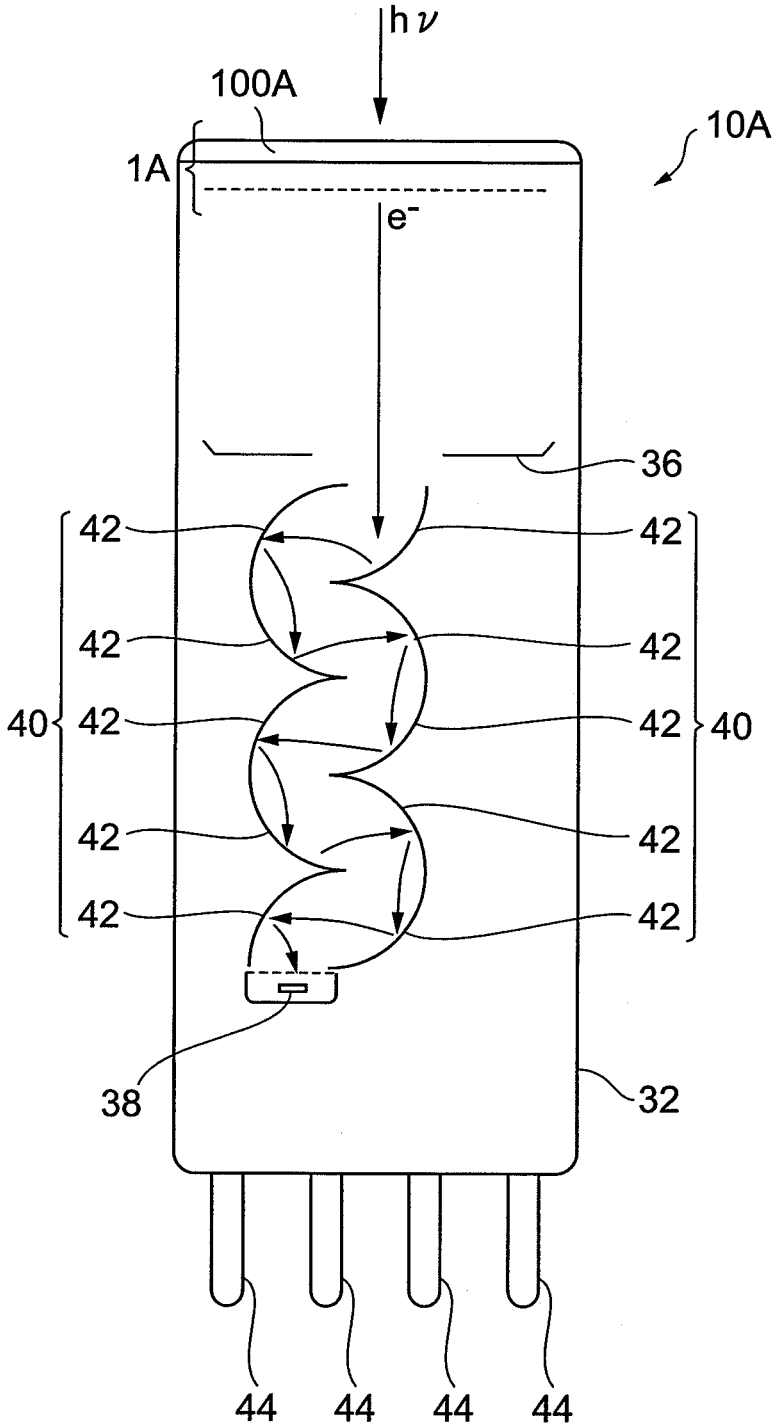
FIG. 2 is a view showing a cross sectional structure of a photomultiplier (included in an electron tube according to the present invention) to which, as a photocathode according to the present invention, a transmissive photocathode has been applied.

FIG. 2 is a view showing a cross sectional structure of a photomultiplier (included in an electron tube according to the present invention) applied with the aforementioned transmissive photocathode 1A.

The transmissive photoelectron tube 10A comprises a transparent container 32 having a faceplate that transmits an incident light hν. The faceplate of the transparent container 32 functions as the supporting substrate 100A of the transmissive photocathode 1A. In the transparent container 32, arranged is a photoelectron emitting layer 300 via an underlayer 200, and provided is a focusing electrode 36 that guides emitted photoelectrons to an electron multiplier section 40, the electron multiplier section 40 that has a plurality of stages of dynodes for cascade-multiplying secondary electrons, and an anode 38 that collects multiplied secondary electrons. In this manner, the transparent container 32 accommodates at least, a part of the transmissive photocathode 1A, the electron multiplier section 40 and the anode 38.

The electron multiplier section 40 provided between the focusing electrode 36 and anode 38 is constituted by a plurality of dynodes (electrodes) 42. Each dynode 42 is electrically connected with a stem pin 44 provided so as to penetrate through the container 32.

Figure 3:
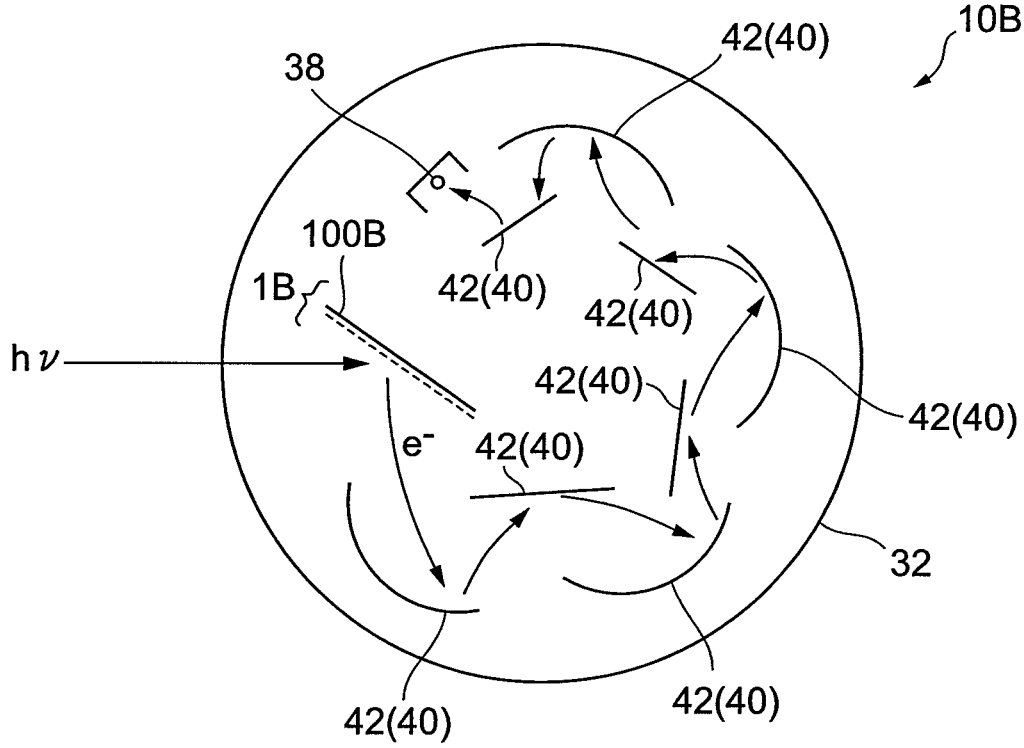
FIG. 3 is a view showing a sectional structure of a photomultiplier (included in an electron tube according to the present invention) to which, as a photocathode according to the present invention, a reflective photocathode has been applied.

On the other hand, FIG. 3 is a view showing a cross sectional structure of a photomultiplier (included in an electron tube according to the present invention) applied with the aforementioned reflective photocathode 1B.

Although the reflective photoelectron tube 10B comprises a transparent container 32 having a faceplate that transmits an incident light hν, the whole of the reflective photocathode 1B including the supporting substrate 100B is arranged in the transparent container 32. Further, in the transparent container 32, provided is an electron multiplier section 40 that has a plurality of stages of dynodes for cascade-multiplying photoelectrons emitted from the reflective photocathode 1B, and an anode 38 that collects secondary electrons multiplied by the electron multiplier section 40. In this manner, the transparent container 32 accommodates at least, the whole of the reflective photocathode 1B, the electron multiplier section 40, and the anode 38.

The electron multiplier section 40 provided between the reflective photocathode 1B and anode 38 is constituted by a plurality of dynodes (electrodes) 42. Each dynode 42 is electrically connected with a stem pin provided so as to penetrate through the transparent container 32.

Next, a plurality of samples prepared as photocathodes according to the present invention will be described. Although the prepared samples are transmissive photocathodes, with regard to characteristics of reflective photocathodes, description will be omitted since it can be easily inferred that the same characteristics as those of the transmissive photocathodes can be expected. FIG. 4A is a table for explaining types of underlayer structures applied to a plurality of samples (hereinafter, referred to as transmissive samples) prepared as the photocathode 1A. In addition, FIG. 4B is a table for explaining types of photoelectron emitting layer structures applied to a plurality of prepared transmissive samples. That is, the types of prepared transmissive samples are 20 types obtained by combination of five types of underlayers 200 and four types of photoelectron emitting layers 300.

As shown in the table of FIG. 4A, structure No. 1 of the underlayer 200 is a BeO single layer. Structure No. 2 of the underlayer 200 is a double-layer structure of an MgO single layer and a BeO single layer. At an interface between the MgO single layer and BeO single layer, an alloy (BeO—MgO) is formed. Here, in the structure No. 2, either single layer may contact with the supporting substrate 100. Also, in manufacturing of the structure No. 2, BeO may be formed after formation of MgO, and MgO and BeO may be simultaneously vapor-deposited. Structure No. 3 of the underlayer 200 is a double-layer structure of a MnO single layer and a BeO single layer, and at an interface between the MnO single layer and BeO single layer, an alloy (BeO—MnO) is formed. In the structure No. 3 as well, either single layer may contact with the supporting substrate 100. Also, in manufacturing of the structure No. 3 as well, BeO may be formed after formation of MnO, and MnO and BeO may be simultaneously vapor-deposited. Structure No. 4 of the underlayer 200 is a single layer comprised of an oxide of a Be-alloy. As structure No. 5 of the underlayer 200, a thin film of $HfO_2$ and $Y_2O_3$ is provided on the supporting substrate 100, and provided on the thin film is a BeO-related foundation (which can be one of the above-mentioned structures No. 1 to No. 4). The thin film can function as an anti-reflection (AR) coating against an incident light. In addition, the film thickness of $HfO_2$ or $Y_2O_3$ is selected from a range of 30 Å to 2000 Å.

On the other hand, as shown in the table of FIG. 4B, structure No. 1 of the photoelectron emitting layer 300 is a K—CsSb ($K_2CsSb$) single layer. Structure No. 2 of the photoelectron emitting layer 300 is a Na—KSb ($Na_2KSb$) single layer. Structure No. 3 of the photoelectron emitting layer 300 is a Cs—Na—KSb ($Cs(Na_2K)Sb$) single layer. Structure No. 4 of the photoelectron emitting layer 300 is a Cs—TeSb ($Cs_2TeSb$) single layer.

The aforementioned $MnO_X$, MeO, and the like are known as materials that transmit light with a wavelength of 300 nm to 1000 nm. In addition, the thin-film material $HfO_2$ exhibits a high transmittance to a light with a wavelength of 300 nm to 1000 nm.

In the above, as a result of a measurement of spectral sensitivity characteristics of a representative transmissive sample among combinations of structures No. 1 to No. 5 applied to the underlayer 200 and structures No. 1 to No. 4 applied to the photoelectron emitting layer 300, excellent spectral sensitivity characteristics were obtained.

Figure 5:
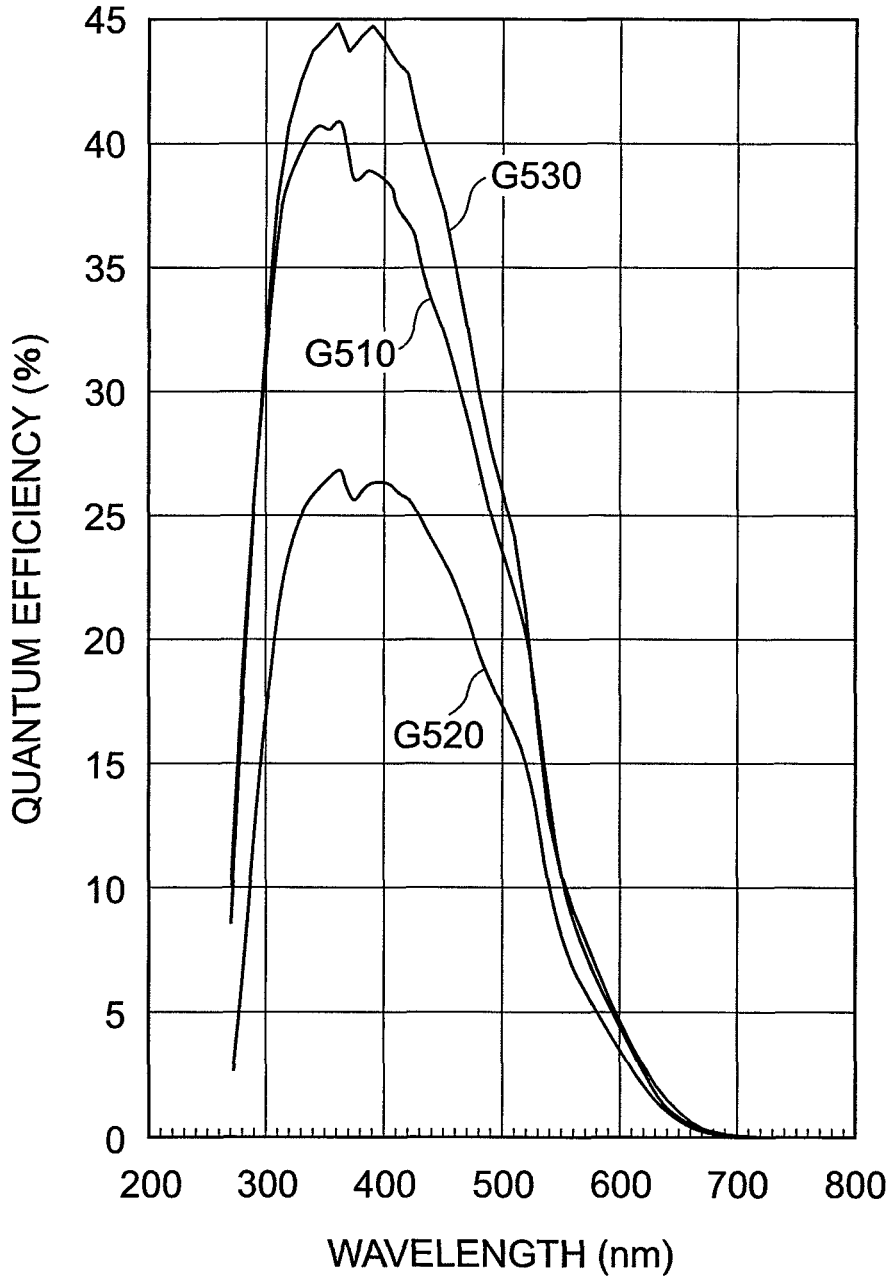
FIG. 5 is a graph showing spectral sensitivity characteristics of photocathodes according to the present invention together with spectral sensitivity characteristics of a photocathode according to a comparative example.

FIG. 5 is a graph showing sensitivity characteristics of transmissive samples with the structures as described above prepared as photocathodes according to the present invention. together with sensitivity characteristics of a comparative sample of a transmissive photocathode according to a comparative example. Here, a graph G510 in FIG. 5 shows spectral sensitivity characteristics of a first transmissive sample having a combination of the aforementioned underlayer structure No. 2 (mixed crystals of BeO and MgO (a mass ratio of Be and Mg is 9:1)) and photoelectron emitting layer structure No. 1, a graph G520 shows spectral sensitivity characteristics of a comparative sample, which is a photocathode according to a comparative example, and a graph G530 shows spectral sensitivity characteristics of a second transmissive sample having a combination of the aforementioned underlayer structure No. 5 (mixed crystals of BeO and MgO with a mass ratio of Be and Mg set to 9:1 are formed on an $HfO_2$ coating) and photoelectron emitting layer structure No. 1.

In the first transmissive sample of the photocathode 1A according to the present invention, the supporting substrate 100A is composed of borosilicate glass, the underlayer 200 is composed of mixed crystals of BeO and MgO (MgO and BeO are simultaneously vapor-deposited on the supporting substrate 100A) with a mass ratio of Be and Mg set to 9:1, and the photoelectron emitting layer 300 is composed of a K—CsSb layer. Moreover, in the first transmissive sample, the thickness of the underlayer 200 is 100 Å, the thickness of the photoelectron emitting layer 300 is 160 Å, and a ratio of the thickness of the photoelectron emitting layer 300 to the thickness of the underlayer 200 is 1.6.

On the other hand, in the comparative sample, the supporting substrate is composed of borosilicate glass, the underlayer is composed of an $MnO_X$ single layer, and the photoelectron emitting layer is composed of a K—CsSb layer. Moreover, in this comparative sample, the thickness of the underlayer is 30 Å, the thickness of the photoelectron emitting layer is 160 Å, and a ratio of the thickness of the photoelectron emitting layer to the thickness of the underlayer is 5.3.

Furthermore, in the second transmissive sample of the photocathode 1A according to the present invention, the supporting substrate 100A is composed of borosilicate glass. The underlayer 200 is composed of $HfO_2$ vapor-deposited as an AR coating on the supporting substrate 100A and mixed crystals of BeO and MgO (MgO and BeO are simultaneously vapor-deposited on the $HfO_2$ coating) with a mass ratio of Be and Mg set to 9:1. And, the photoelectron emitting layer 300 is composed of a K—CsSb layer. Moreover, in the second transmissive sample, the thickness of the underlayer 200 is 400 Å (the thickness of the $HfO_2$ is 300 Å; the thickness of the mixed crystals of BeO and MgO is 100 Å), the thickness of the photoelectron emitting layer 300 is 160 Å, and a ratio of the thickness of the photoelectron emitting layer 300 to the thickness of the underlayer 200 is 0.4. Here, a ratio of the thickness of the photoelectron emitting layer 300 to the thickness of the layer constituted by the mixed crystals of BeO and MgO is 1.6.

As can be seen from FIG. 5, due to an area containing the mixed crystals of BeO and MgO (the mass ratio of Be and Mg was 9:1) being provided in at least a part of the underlayer 200, the transmissive samples prepared as photocathodes according to the present invention has been improved in quantum efficiency in the entire usable wavelength range in comparison with the comparative sample. In particular, the quantum efficiency at a wavelength of 360 nm is 26.9% in the comparative sample, while in the first transmissive sample, this is 40.8%, and in the second transmissive sample, 44.8%, so that an increase in sensitivity of about 50% or more has been confirmed. For dramatically improving the effective quantum efficiency as such, in the photocathode according to the present invention, it is preferable that the thickness of the underlayer 200 is set such that the ratio of the thickness of the photoelectron emitting layer 300 to the thickness of the underlayer 200 is within a range of 0.1 or more but 100 or less. In addition, it is preferable that the thickness of the underlayer 200 is set so as to be within a range of 20 Å to 500 Å, and the thickness of the photoelectron emitting layer 300, within a range of 50 Å and 2000 Å.

Meanwhile, the quantum efficiency of the various transmissive samples at the wavelength 360 nm, obtained by changing the structure of the underlayer 200 to the K—CsSb photoelectron emitting layer 300, become as follows. That is, in the case of the underlayer 200 provided as a BeO single layer (structure No. 1), the quantum efficiency of the obtained transmissive sample was 38.8%. In addition, in the case of the underlayer 200 with structure No. 2 where BeO was vapor-deposited after vapor deposition of MgO, the quantum efficiency of the obtained transmissive sample was 38%. Further, in the case of the underlayer 200 composed of mixed crystals of BeO and MnO (the mass ratio of Be and Mn was 9:1) (structure 3), the quantum efficiency of the obtained transmissive sample was 38%. In the case of the underlayer 200 composed of mixed crystals of BeO and $Y_2O_3$ (the mass ratio of Be and Y was 9:1), the quantum efficiency of the obtained transmissive sample was 41.2%. Further, in the case of the underlayer 200 composed of mixed crystals of BeO and $HfO_2$ (the mass ratio of Be and Hf was 9:1) (structure 3), the quantum efficiency of the obtained transmissive sample was 39.6%. In the transmissive samples having any underlayer structures, an increase in sensitivity in comparison with the comparative sample was confirmed. In particularly, in the case of the second transmissive sample (including the supporting substrate 100A of borosilicate glass, the underlayer 200 composed of a $HfO_2$ coating and mixed crystals of BeO and MgO, and the K—CsSb photoelectron emitting layer 300), a high quantum efficiency with a peak of 44.8% could be obtained as shown in FIG. 5.

Here, the fact that the samples prepared as photocathodes according to the present invention were markedly improved in spectral sensitivity in comparison with the comparative sample as described above is considered to be due to that the underlayer 200 containing BeO functions as a barrier layer. More specifically, an alkali metal (for example, K, Cs, and the like) contained in the photoelectron emitting layer 300 is dispersed at the time of heat treatment in a manufacturing process of the photocathode and thus considered to move to a layer adjacent to the photoelectron emitting layer 300. In this case, it is assumed that a decline in the effective quantum efficiency results therefrom. On the other hand, when the underlayer 200 containing BeO is provided as an adjacent layer in contact with the photoelectron emitting layer 300, it is considered that diffusion of an alkali metal (for example, K, Cs, and the like) contained in the photoelectron emitting layer 300 is effectively suppressed at the time of heat treatment in a manufacturing process. The fact that a high effective quantum efficiency can be realized in a photocathode with the underlayer 200 containing BeO can be assumed to result therefrom. Furthermore, it can be assumed that this underlayer 200 functions so as to reverse the direction of, out of photoelectrons generated within the photoelectron emitting layer 300, photoelectrons traveling toward the supporting substrate 100 side. For this reason, it is considered that the quantum efficiency of the photocathode as a whole is dramatically improved.

In the case that a plurality of types of alkaline metals are contained in the photoelectron emitting layer 300, it is necessary to supply alkali vapor a plurality of times. Therefore, a decline in the quantum efficiency due to a heat treatment is suppressed, which is very effective.

As described above, the photocathode according to the present invention is dramatically improved in the effective quantum efficiency in comparison with the conventional photocathode.

From the invention thus described, it will be obvious that the embodiments of the invention may be varied in many ways. Such variations are not to be regarded as a departure from the scope of the invention, and all such modifications as would be obvious to one skilled in the art are intended for inclusion within the scope of the following claims.

What is claimed is:

1. A photocathode having a light incident surface into which light with a predetermined wavelength is made incident and a photoelectron emitting surface which emits photoelectrons in response to incidence of the light, comprising:

a supporting substrate having a first main surface and a second main surface opposing the first main surface;

a photoelectron emitting layer, in which the photoelectrons are generated in response to incidence of the light, having a first main surface and a second main surface opposing said first main surface, and comprised of a compound of antimony and an alkali metal, said photoelectron emitting layer being provided on the second main surface of said supporting substrate such that the first main surface of said photoelectron emitting layer faces the second main surface of said supporting substrate; and an underlayer provided between said supporting substrate and said photoelectron emitting layer while being in direct contact with the second main surface of said supporting substrate and the first main surface of said photoelectron emitting layer, said underlayer being comprised of an oxide of a beryllium alloy or a beryllium oxide, wherein said supporting substrate is comprised of a material that transmits light with the predetermined wavelength made incident thereinto, and wherein said photocathode includes a transmissive photocathode where the first main surface of said supporting substrate functions as the light incident surface, while the second main surface of said photoelectron emitting layer functions as the photoelectron emitting surface.

2. A photocathode according to claim 1, wherein a thickness of said underlayer is set such that a ratio of a thickness of said photoelectron emitting layer to the thickness of said underlayer falls within a range of 0.1 or more but 100 or less.

3. A photocathode according to claim 1, wherein said underlayer includes mixed crystals of the beryllium oxide and a magnesium oxide.

4. A photocathode according to claim 1, wherein said underlayer includes mixed crystals of the beryllium oxide and a manganese oxide.

5. A photocathode according to claim 1, wherein said underlayer includes mixed crystals of the beryllium oxide and an yttrium oxide.

6. A photocathode according to claim 1, wherein said underlayer includes mixed crystals of the beryllium oxide and a hafnium oxide.

7. A photocathode according to claim 1, wherein said underlayer comprises a layer containing the beryllium oxide, and a hafnium oxide film provided between said layer containing the beryllium oxide and said supporting substrate.

8. A photocathode according to claim 1, wherein the alkali metal contains at least one of cesium, potassium, and sodium.

9. A photocathode according to claim 1, wherein said supporting substrate is comprised of a material that transmits light with a wavelength of 300 nm to 1000 nm made incident thereinto.

10. An electron tube comprising:

a photocathode according to claim 9;

an anode collecting electrons emitted from said photocathode; and a container accommodating said photocathode and said anode.

11. A photomultiplier comprising:

a photocathode according to claim 9;

an electron multiplier section having a plurality of stages of dynodes for cascade-multiplying photoelectrons emitted from said photocathode, said electron multiplier including at least a first stage of dynode which constitutes a part of said plurality of stages of dynodes and has a secondary electron emitting surface facing said photocathode;

an anode collecting secondary electrons emitted from said electron multiplier section; and a container accommodating said photocathode, said electron multiplier section, and said anode.

12. A photocathode according to claim 1, wherein said photoelectron emitting layer is comprised of $K_2CsSb$.

13. A photocathode according to claim 1, wherein said photoelectron emitting layer is comprised of $Na_2KSb$.

14. A photocathode according to claim 1, wherein said photoelectron emitting layer is comprised of $Cs(Na_2K)Sb$.

15. A photocathode according to claim 1, wherein said photoelectron emitting layer is comprised of $Cs_2TeSb$.

* * * * *